US006721523B2

(12) United States Patent
Sugiura et al.

(10) Patent No.: US 6,721,523 B2
(45) Date of Patent: Apr. 13, 2004

(54) CHARGING DEVICE, IMAGE FORMING UNIT AND IMAGE FORMING DEVICE

(75) Inventors: Kenji Sugiura, Yokohama (JP); Yasushi Nakazato, Tokyo (JP); Takahiko Tokumasu, Tokyo (JP); Tohru Nakano, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/253,936

(22) Filed: Sep. 25, 2002

(65) Prior Publication Data

US 2003/0072587 A1 Apr. 17, 2003

(30) Foreign Application Priority Data

Sep. 25, 2001 (JP) ..... 2001-290447
Nov. 14, 2001 (JP) ..... 2001-349198

(51) Int. Cl.[7] ..... G03G 15/02
(52) U.S. Cl. ..... 399/176; 399/100
(58) Field of Search ..... 399/174, 175, 399/176, 100, 115; 361/225

(56) References Cited

U.S. PATENT DOCUMENTS 5,146,280 A * 9/1992 Kisu ..... 399/176
6,381,432 B1 * 4/2002 Hattori ..... 399/176
2001/0012460 A1 * 8/2001 Sato et al. ..... 399/176

FOREIGN PATENT DOCUMENTS

| | | | |
|---|---|---|---|
| JP | 2001-42751 | | 2/2001 |
| JP | 2001-188403 A | * | 7/2001 |
| JP | 2001-194868 | | 7/2001 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A charging device is provided. The charging device comprises a charging member having two spacers made of tape, and the charging member is pressed to contact with the non-image forming region of an image supporter. The surface of the charging member between the spacers is opposite to the surface of the image supporter by a tiny gap. A charging voltage is then applied to the charging member to charge the image supporter. As the image supporter rotates, a large variation of the tiny gap can be avoided. The pressing force of the spacers against the image supporter is set at 4 N to 25 N (Newton), and in a moving direction of the surface of the supporter, a contact width of a contact portion where the spacer is pressed to contact with the image supporter is set below 0.5 mm.

74 Claims, 6 Drawing Sheets

CHARGING DEVICE, IMAGE FORMING UNIT AND IMAGE FORMING DEVICE

CROSS-REFERENCE TO RELATED APPLICATION

This application claims the priority benefit of Japanese application serial No. 2001-290447, filed on Sep. 25, 2001 and 2001-349198, filed on Nov. 14, 2001.

BACKGROUND OF THE INVENTION

1. Field of the Invention

This invention relates in general to a charging device, which comprises a charging member, disposed opposite to a surface of an image supporter and pressed against the image supporter, wherein a charging voltage is applied to the charging member to discharge between the charging member and the surface of the image supporter, so as to charge the image supporter, and the charging member further comprises spacers in contact with a portion other than an image forming region of the image supporter, and a portion of the charging member opposite to the image forming region of the image supporter separates from the surface of the image supporter by a tiny gap. The invention also relates to an image forming unit with the image supporter and the charging member. The invention also relates to an image forming device having the above charging device.

2. Description of Related Art

Conventionally, it is well-known that the aforementioned charging device is used in an image forming device where an image supporter is charged by a charging device, the charged image supporter is then exposed to form an electrostatic latent image thereon, and the electrostatic latent image is visualized as a toner image. The image forming device can be an electronic copying machine, a facsimile, a printer, or a multi-function machine with at least two of the above functions. Since a portion of the charging member opposite to the image forming region of the image forming supporter of the charging device has a tiny gap rose from the surface of the image supporter, the drawback that the charging member is in contact with the surface of the surface supporter to contaminate the charging member can be suppressed, or the degradation of the surface of the image supporter at the early stage can be avoided.

If the tiny gap is too large, streamer discharge occurs when using this charging device; and therefore, the surface of the image supporter cannot be uniformly charged, so that a spotted abnormal image occurs on the toner image that is formed on the image supporter and the image quality degrades. Conventionally, the tiny gap between the charging member and the surface of the image supporter is set below 100 $\mu$m to prevent the streamer discharge from occurring, so as to improve the image quality of the toner image. However, according to the study of the present invention, it can be understood that only setting the ting gap below 100 $\mu$m has its limitation to improve the image quality of the toner image. The reason is further discussed as follows.

The charging device using the above charging member is used to discharge at the gap between the charging member and the surface of the image supporter so that the image supporter is charged. Discharge gas such as oxynitride is created by discharge, and the discharge gas is combined with the material in the air to form discharge products that will adhere on the surface of the image supporter. As the amount adhered to the surface increases, the discharge products absorb the water in the air and the resistance gets lower, so that the resistance of the surface of the image supporter is reduced. When the image supporter is charged, exposed to form the electrostatic latent image that will be visualized as the toner image, in general, the abnormal image such as the image stream or image fade occurs.

The abnormal image is highly related to the size of the tiny gap. It can be understood that when the tiny gap is set a certain suitable value below 100 $\mu$m, the amount of the discharge products adhered onto the surface of the image supporter is minimized. As the tiny gap is larger, or in contrast, smaller than the optimum value, the amount of the discharge products adhered onto the surface of the image supporter increases. The explanation related to this point can be understood by the experiment example in the following description.

As can be realized from above description, if the tiny gap between the charging member and surface of the image supporter is set the optimum value or near that value, the amount of the discharge products adhered onto the surface of the image supporter is reduced, so that the occurrence of the abnormal image can be effectively suppressed, or can be avoided.

The charging member is pressed by a pressure means. Since the spacers of the charging member is pressed to contact with the image supporter, if the surface of the image supporter is slightly waved or slightly acentric, the pressing force applied to the charging member by the pressure means varies when the image supporter rotates. In addition, due to the impacting force applied to the image supporter, the image supporter in rotation vibrates, and therefore, the charging member jumps on the surface of the image supporter, so that the spacers is instantly separated from the surface of the image supporter by a little distance. Because the pressing force applied to the charging member varies or the charging member jumps over the image supporter, therefore even though the tiny gap is set to the optimum value while the image supporter stops, the tiny gap deviates from the optimum value greatly when the surface of the image supporter rotates to perform the charging operation. In this way, the amount of the discharge products adhered on the surface of the image supporter increases, and therefore, the occurrence of the abnormal image cannot be avoided.

SUMMARY OF THE INVENTION

According to the foregoing description, it is an object of the present invention to provide a charging device, wherein even though the pressing force applied to the charging member varies, the large variation of the tiny gap between the charging member and the surface of the image supporter can be stopped and therefore the occurrence of the abnormal image can be effectively suppressed.

The second object of the present invention is to provide an image forming unit with the above charging device, so that the image forming unit can effect the above advantages.

The third object of the present invention is to provide an image forming device with the above charging device, so that the image forming unit can effect the above advantages.

According to the objects mentioned above, the present invention provides a charging device, which comprises a charging member, disposed opposite to a surface of an image supporter and pressed against the image supporter, wherein a charging voltage is applied to the charging member to discharge between the charging member and the surface of the image supporter so as to charge the image supporter. The charging member further comprises spacers in contact with a portion other than an image forming region of the image supporter, and a portion of the charging member opposite to the image forming region of the image supporter separates from the surface of the image supporter by a tiny gap. The magnitude of a total load applied in perpendicular to the surface of the image supporter from the spacers is set 4 N to 25 N (Newton), and in a moving direction of the surface of the supporter, a contact width of a contact portion where the spacer is pressed to contact with the image supporter is set below 0.5 mm.

The magnitude of the total load is preferably set 6 N to 15 N. In addition, the tiny gap is set 20–50 $\mu$m. The charging voltage where an AC voltage is overlapped to a DC voltage is applied to the charging member. In addition, the voltage between peaks of the AC voltage applied to the charging member is set more than two times of an initial charging voltage of the image supporter.

The surface of the charging member opposite to a discharge region is a curve that is gradually separated from the surface of the image supporter, from a nearest portion with respect to the surface of the image supporter to an upstream and a downstream sides in the moving direction of the surface of the image supporter, respectively.

The charging member is formed in a cylindrical shape, and the charging member is a rotatable roller. In addition, the tiny gap is set larger than a toner grain size of a toner image formed on the image supporter. The tiny gap is set larger than a grain size of a carrier in a developer used in a developing device that is to form the toner image on the surface of the image supporter.

The charging device can further comprise a cleaning member for cleaning up the surface of the charging member. The cleaning member is rotationally supported.

In the above charging device, the charging member further comprises: a conductive base body where the charging voltage is applied thereon; and a resistant layer fixed on the conductive base body. Protrusions are formed on a portion of the resistant layer other than the portion opposite to the image forming region of the image supporter, to protrude towards the surface of the image supporter, and the spacers are formed by the protrusions.

Alternatively, the charging member further comprises a conductive base body where the charging voltage is applied thereon; a resistant layer fixed on the conductive base body; and a surface layer, deposited on the resistant layer. The thickness of a surface portion where the surface layer is not opposite to the image forming region of the image supporter is thicker than that of a surface portion where the surface layer is opposite to the image forming region of the image supporter, and the spacers are formed by the thicker surface portion of the surface layer.

Alternatively, the charging member further comprises a conductive base body where the charging voltage is applied thereon; a resistant layer fixed on the conductive base body; and a surface layer, deposited on the resistant layer. The surface layer comprises a base material and an electron conductive agent. The volume resistance rate of the surface layer is set higher than that of the resistant layer.

The invention further provides a charging device, which comprises a charging member, disposed opposite to a surface of an image supporter and pressed against the image supporter, wherein a charging voltage is applied to the charging member to discharge between the charging member and the surface of the image supporter, so as to charge the image supporter. The charging member further comprises spacers in contact with a portion other than an image forming region of the image supporter, and a portion of the charging member opposite to the image forming region of the image supporter separates from the surface of the image supporter by a tiny gap. In a moving direction of the surface of the supporter, a contact width of a contact portion where the spacer is pressed to contact with the image supporter is set below 0.5 mm.

The charging voltage where an AC voltage is overlapped to a DC voltage is applied to the charging member. In addition, the voltage between peaks of the AC voltage applied to the charging member is set more than two times of an initial charging voltage of the image supporter.

The surface of the charging member opposite to a discharge region is a curve that is gradually separated from the surface of the image supporter, from a nearest portion with respect to the surface of the image supporter to an upstream and a downstream sides in the moving direction of the surface of the image supporter, respectively.

The charging member is formed in a cylindrical shape, and the charging member is a rotatable roller. Preferably, the tiny gap is set below 100 $\mu$m. In addition, the tiny gap is set larger than a toner grain size of a toner image formed on the image supporter. The tiny gap is set larger than a grain size of a carrier in a developer used in a developing device that is to form the toner image on the surface of the image supporter.

The charging device can further comprises a cleaning member for cleaning up the surface of the charging member. The cleaning member is rotationally supported.

In the above charging device, the charging member further comprises: a conductive base body where the charging voltage is applied thereon; and a resistant layer fixed on the conductive base body. Protrusions are formed on a portion of the resistant layer other than the portion opposite to the image forming region of the image supporter, to protrude towards the surface of the image supporter, and the spacers are formed by the protrusions.

Alternatively, the charging member further comprises a conductive base body where the charging voltage is applied thereon; a resistant layer fixed on the conductive base body; and a surface layer, deposited on the resistant layer. The thickness of a surface portion where the surface layer is not opposite to the image forming region of the image supporter is thicker than that of a surface portion where the surface layer is opposite to the image forming region of the image supporter, and the spacers are formed by the thicker surface portion of the surface layer.

Alternatively, the charging member further comprises a conductive base body where the charging voltage is applied thereon; a resistant layer fixed on the conductive base body; and a surface layer, deposited on the resistant layer. The surface layer comprises a base material and an electron conductive agent. The volume resistance rate of the surface layer is set higher than that of the resistant layer.

The invention further provides an image forming unit, which comprises a charging member, as described above, and an image supporter. The image supporter and the charging member are integrally installed, and capable of detaching from or attaching to a main body of an image forming device. In addition, the image forming unit can further comprises a contact member that is in contact with the image supporter.

The invention further provides an image forming device, which comprises a charging device, equipped with a charging member as described above, and an image supporter. In the image forming device, the image supporter is formed as a photoreceptor having a surface layer made of amorphous silicon. Alternatively, the image supporter is formed as a photoreceptor having a surface layer where fillers are dispensed therein.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
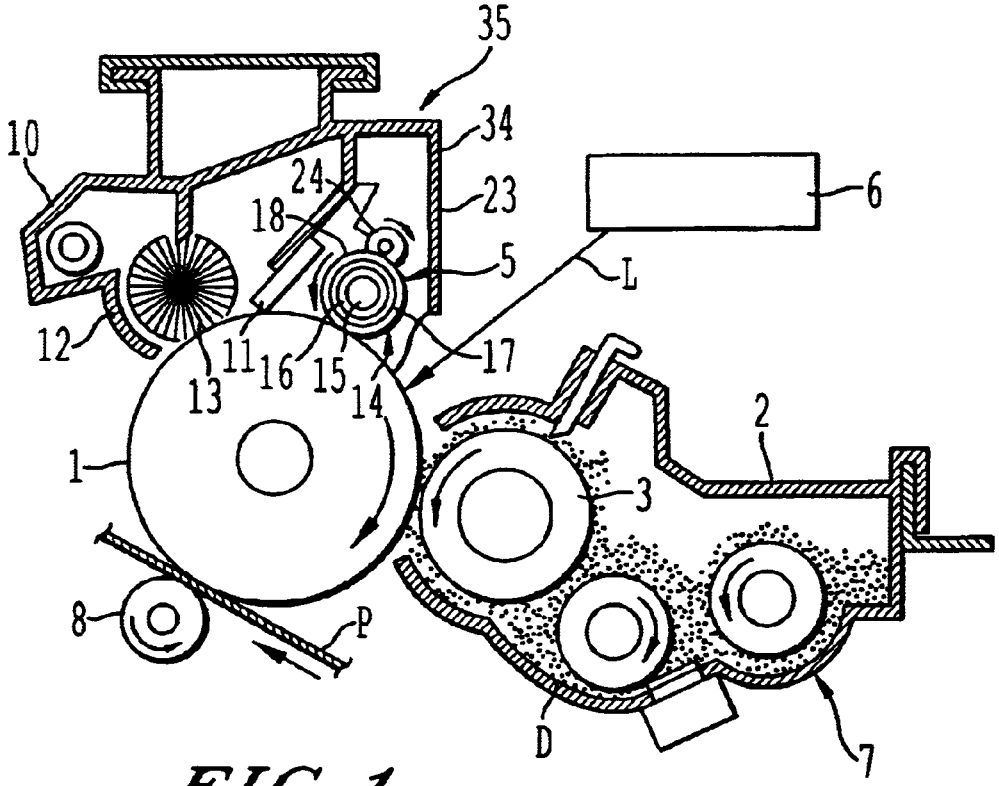
FIG. 1 is a cross-sectional view showing an exemplary image forming device with a charging device.

The preferred embodiment according to the present invention is described in detail accompanying with the attached drawings. FIG. 1 is a cross-sectional view showing an exemplary image forming device with a charging device. The image forming device comprises an image supporter 1 disposed within an image forming device main body (not shown). The image supporter 1 comprises a drum type photoreceptor having photoreceptive layer on a cylindrical and conductive-based outer circumferential surface. However, an endless belt type image supporter, which is wound on a plurality of rollers and is rotationally driven, can be also used.

Referring to FIG. 1, when operating the image forming process, the image forming device is rotationally driven in clockwise direction with respect to FIG. 1. At this time, the image supporter 1 is charged to a predetermined polarity by a charging device 5. The charging device is described in detail in following paragraphs.

An optically modulated laser beam L from a laser writing unit 6 (as an example of an exposure device) is irradiated onto the image supporter charged by the charging device. In this manner, an electrostatic latent image is formed on the image supporter 1. In the drawing, the absolute value of the surface potential of the image supporter 1 where the laser beam is irradiated thereon is reduced, at which the electrostatic latent image (image portion) is formed, and the other portion where the laser beam L does not irradiate thereon and the absolute value of the potential keeps a high value becomes a background portion. When the electrostatic latent image passes through the developing device 7, the electrostatic latent image is visualized as a toner image by the toner charged with a predetermined polarity. In this image forming device, an exposure device having a LED array or an exposure device where the document image is formed on the image supporter can be used.

On the other hand, a transfer material, such as a transfer paper, is sent out from a paper feeding device (not shown). The transfer material P is sent to between a transferring device 8 disposed opposite to the image supporter 1 and the image supporter 1 at a predetermined timing. At this time, the toner image formed on the image supporter is electrostatically transferred onto the transfer material P. Next, the transfer material P where the toner image has been transferred thereon passes through a fixing device (not shown). At this time, by the effects of heat and pressure, the toner image is fixed onto the transfer material. The transfer material P passing through the fixing device is ejected to a paper ejecting section (not shown). The residual toner remained on the surface of the image supporter without being transferred to the transfer material P is removed by a cleaning device 12.

The developing device 7 comprises a developing case 2 containing dry type developer D and a developing roller 3 for transporting the developer D while supporting the developer D. The developer D can use, for example, dry type developer composed of toner and carrier, or one component developer only having carrier. In addition, a developing device using a liquid developer can be also used. The developing roller 3 is rotationally driven in the direction of the arrow. At this time, the developer D is supported and transported on the circumferential surface of the developing roller 3. The toner in the developer D moved to the developing region between the developing roller 3 and the image supporter 1 is electrostatically moved to the electrostatic latent image. Then, the electrostatic latent image is visualized as the toner image.

In addition, the transferring device 8 comprises a transfer roller where the transfer voltage of charge polarity and its reverse polarity of the toner on the image supporter 1 is applied thereon. However, a transferring made of a transfer brush, a transfer blade or a corona discharger with a corona wire can be used. In addition, in stead of that the toner image on the image supporter 1 is directly transferred onto the transfer material P (as the final recording medium), the toner image on the image supporter 1 can be transferred onto a transfer material that is an intermediate transfer material and then the toner image is transferred onto the final recording medium.

In addition, the cleaning device 12 comprises a cleaning blade 11 whose base is supported by a cleaning case 10, and a cleaning member made of a fur brush 13 rotatably supported by the cleaning case 10. This cleaning member is in contact with the surface of the image supporter 1 for cleaning up the residual toner adhered on the surface of the image supporter 1. A suitable cleaning device other than the above cleaning device can be also used.

As described above, the image forming device of the embodiment comprises the image supporter 1, the charging device 5 for charging the image supporter 1, the exposure device where the image supporter 1 charged by the charging device 5 is exposed to form the electrostatic latent image, the developing device 7 to visualize the electrostatic latent image as the toner image, the transferring device 8 to transfer the toner image onto the transfer material, and the cleaning device 12 to remove the residual toner adhered on the surface of the image supporter 1 after the toner image is transferred. However, the cleaning device 12 can be omitted, and the residual toner can be removed, for example, by the developing device.

Figure 2:
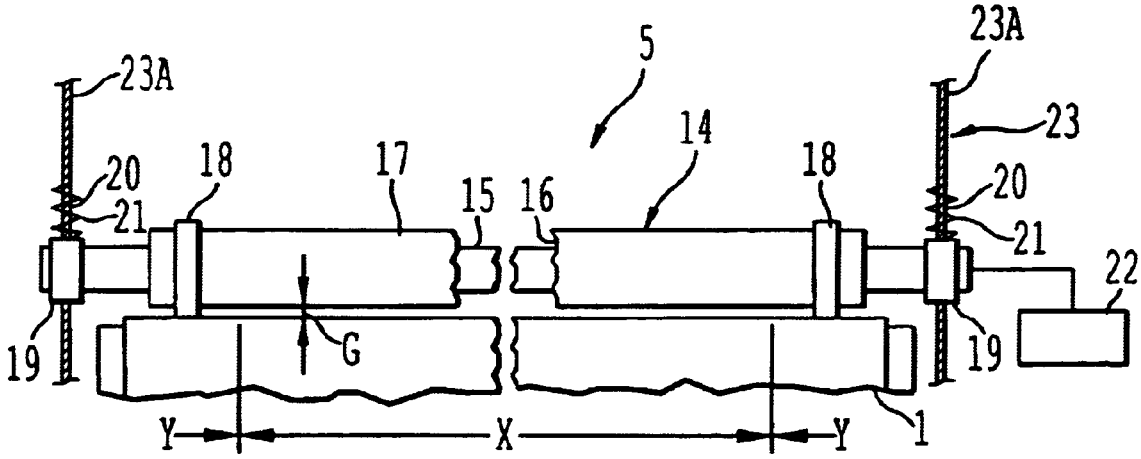
FIG. 2 shows the detail structure of a portion of the charging member and the image supporter.
Figure 3:
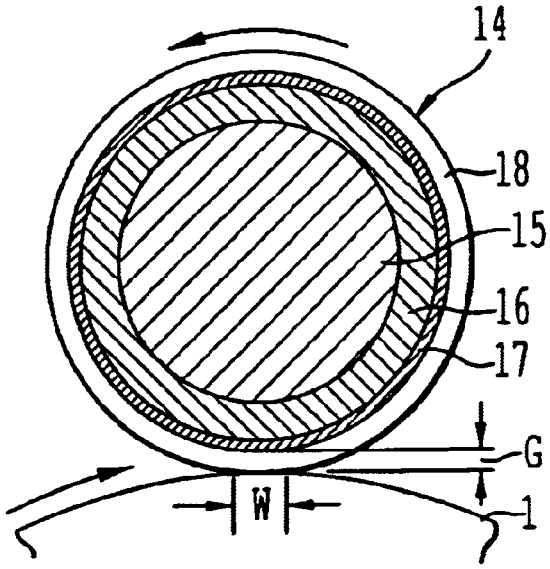
FIG. 3 is an enlarged cross-sectional view of the charging member.

As shown in FIGS. 1 and 2, the charging device 5 has a charging member 14 disposed opposite to the surface of the image supporter 1. The charging member 14 can be formed in any suitable structure, but in the example of FIGS. 1 and 2, the charging member 14 is made of a charging roller. This charging member 14, as shown in FIG. 3, comprises a conductive base body 15 formed in a cylindrical shape, a cylindrical resistant layer 16 fixed on the base body 15 and a surface layer 17 deposited on the outer surface of the resistant layer 15.

The base body 15, for example, is made of a metal material with a high rigidity, such as stainless steel or aluminum with a diameter of above 8–20 mm, or can be also made of conductive resin with a high rigidity whose volume resistance rate is below $1\times10^3$ Ω·cm, or preferably below $1\times10^2$ Ω·cm. In this example, the base body 15 forms the core axis of the charging roller.

The volume resistance rate of the resistant layer 16 is set about $10^5$~$10^9$ Ω·cm, and the thickness of the resistant layer 16 is set about 1–2 mm. The volume resistance rate of the surface layer 17 is set about $10^6$~$10^{11}$ Ω·cm. It is preferred that the volume resistance rate of the surface layer 17 is slightly higher than that of the resistant layer 16. The thickness of the surface layer 17 is about 10 μm, for example. In this manner, the resistant layer 16 and the surface layer 17 forms an intermediate resistant body, and the exemplary material is described in detail as follows.

As shown in FIG. 2, the charging member 14 made of the charging roller is opposite to the surface of the image supporter 1 and extends in parallel with the image supporter 1. The electrostatic latent image is formed within a range indicated by X, i.e., the image forming region on the image supporter 1. Spacers 18 formed on the charging member 14 is to press the Y portion (other than the X portion), i.e., the non image forming region, of the image supported 1. Each spacer 18 presses to contact with the surface of the non-image forming region Y out of the image forming region X in perpendicular with the moving direction of the surface of the image supporter 1.

As shown, the resistant layer 16 and the surface layer 17 extend beyond each outmost end of the image supporter 1 in its axial direction, further than the image forming region X of the image supporter 1. The spacers 18 are respectively disposed on the charging member 14 whose both ends extend further than the outmost end of the image supporter 1. In this manner, each spacer 18 is pressed to contact with the surface of the photoreceptive layer of the image supporter 1. The spacer 18 is made of insulating material, or a material with a volume resistance rate equal to or larger than that of the resistant layer 16

In FIG. 2, the charging member 14 has two spacers 18 formed thereon, but three more spacers can also disposed on the charging member 14. At least, each of the spacers is pressed to contact with each non-image forming region in the axial direction of the image supporter 1. In addition, the spacer of this embodiment is made of a thin tape that is adhered and wrapped one round on the outer surface of the surface layer 17 by adhesive. The outer diameter of the tape is slightly larger than the outer diameter of the portion where the resistant layer 16 and the surface layer 17 are formed on the charging member.

As shown in FIG. 2, each end of the base body in the longitudinal direction are rotatably supported by respective bearings 19. Each bearing 19 is embedded and can be slide in a hole 20 formed on each side plate 23A of the casing 23 of the charging device 5 (referring to FIG. 1) to be able to be away from or close to the image supporter 1. By a pressing means formed by a compressing spring 21, the bearings 19 are pressed towards the surface of the image supporter 1. In this way, the spacers 18 are pressed to contact with the surface of the image supporter 1. A tiny gap G is created from the surface of the image supporter 1 to the portion of the charging member 14 between the two spacers 18, i.e., the portion of the charging member 14 opposite to the image forming region X. The tiny gap G is a gap at the closest portion between the image supporter 1 and the portion of the charging member 14 opposite to the image forming region X of the image supporter 1.

When the image forming process is operated, the charging member 14 is driven to rotate in the direction of the arrow (FIG. 1) because of the rotation of the image supporter 1. The charging member 14 can be rotationally driven by a driving device (not shown). At this time, the conductive base body 15 of the charging member 14 is electrically coupled to the power source 22, so that a predetermined charging voltage is applied to the charging member 14. In this manner, discharge is created at the gap between the charging member 14 and the image supporter 1, and at least the image forming region X on the image supporter I is charged with the predetermined polarity.

As shown in FIG. 1, the charging device 5 comprises a cleaning member 24 for cleaning up the outer surface of the charging member 14. The cleaning member 24 is installed within the casing 23 and is able to rotate therein. The cleaning member 14 is in contact with the outer surface of the surface layer 17 of the charging member 14 by the weight of the cleaning member 24 itself to clean up the outer surface of the charging member 14. The cleaning member 24 is installed on demand, and can be omitted.

As described above, the charging device 5 comprises the charging member 14 that is disposed at a position opposite to the surface of the image supporter 1 that is rotationally driven and is pressed to the image supporter 1, and a pressure means for pressing the charging member 14 to contact with the image supporter 1. The charging voltage is applied to the charging member 14 to create a discharge between the charging member 14 and the surface of the image supporter 1. Furthermore, the charging member 14 has spacers 18 to contact with the portions other than the image forming region X of the image supporter 1, and the portion of the charging member 14 opposite to the image forming region X of the image supporter 1 has the tiny gap G separated from the surface of the image supporter 1. Only the spacers 18 of the charging member 14 are in contact with the surface of the image supporter 1. This basic structure does not change in the following example of the charging device and the charging member.

The gap at the closest portion between the outer surface of the charging member 14 and the image supporter 1, i.e. the tiny gap G, is set equal to or below 100 μm, or particularly set a value of 5–100 μm. In this manner, when the charging device 5 is activated, spotted abnormal image due to the streamer discharge can be prevented from occurring. As the tiny gap G gets larger than 100 μm, the discharge pulse gets longer. In addition, as the discharge energy becomes too large, abnormal discharge occurs, so that spotted abnormal image occurs on the toner image. Therefore, by setting the tiny gap G equal to or below 100 μm, these drawbacks can be prevented, which can be confirmed by various experiments.

As described above, there is a need to set the tiny gap G equal to or below 100 μm, but it is preferred to determine the tiny gap G in such a manner that the amount that the discharge products created by the operation of the charging device 5 adheres on the surface of the image supporter 1 can be reduced. In order to clarify this point, the experiment example conducted by the present inventor is described.

In this experiment, the machine parts used and their conditions are as follows.

- copying machine: an improved machine of IMAGIO 4570, made by RICOH, Inc.
- charging roller: comprising the base body, the resin resistant layer, the surface layer, and spacers that are made of two tapes and wrapped to fix around the surface layer, as shown in FIGS. 2 and 3. Tapes with a thickness of 30, 50, 80 μm, including the thickness of the adhesive are respectively used. The charging rolls with the tapes of the above thickness of 30, 50, 80 μm are respectively used.
- charging voltage applied to the charging roller: DC (−950V)+AC (1.4 kHz, sinusoidal wave)
- a load applied in perpendicular with the surface of the image supporter from the two tapes is 10 N (Newton), which is measured when the image supporter stops rotating.
- environment condition: temperature 30C., humidity 90%.
- mechanical condition: no cleaning member for the image supporter.
- others: an experiment for comparison is performed, in which a charging roller without tape is used, and the charging roller is in contact with the surface of the image supporter, so that the tiny gap G is 0.

In order to grasp what dependence between the abnormal image, called image stream, and the variation of the tiny gap G, the charging roller, where the tape thickness maintaining the variation of the tiny gap is varied, is used, and the tiny gap G is intentionally varied to perform each experiment. The copy is continuously performed with three different tiny gaps. 5000 pieces of A4 size transfer paper are laterally sent in for continuous copying, so as to confirm whether the image on the final transfer paper has image stream occurred thereon.

Figure 4:
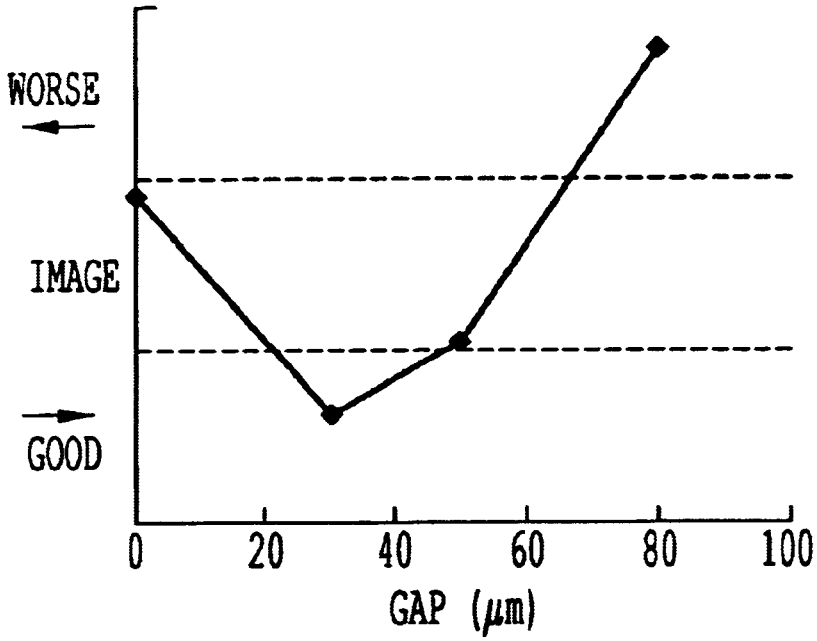
FIG. 4 is a graph showing an experiment result.

FIG. 4 shows the result of the above experiment. In FIG. 4, the horizontal axis represents the tiny gap, and the vertical axis represents the occurring frequency of the image stream phenomenon. The size of the tiny gap is equivalent to the thickness including the adhesive of the tape. From FIG. 4, it can be found that when the tiny gap is a certain value, the abnormal image occurs, i.e., the occurrence of image stream becomes difficult. In FIG. 4, when the tiny gap is about 30 μm, the occurrence of the image stream is minimized. In this manner, the occurrence of the image stream is greatly dependent on the tiny gap, or as being a specified tiny gap, the image stream is minimized.

When the tiny gap is greater than the optimum value, the occurrence frequency of the image stream phenomenon increases, and when the tiny gap gets wider, the voltage required for creating the discharge becomes higher because the ionization space due to the discharge gets large. In the above experiment, the voltage between peaks of the AC voltage applied to the charging roller is 1.6 kV when the tiny gap is 0, 2.0 kV when the tiny gap is 30 μm, 2.2 kV when the tiny gap is 50 μm, and 2.6 kV when the tiny gap is 80 μm.

The tiny gap and the discharge voltage can be explained by Paschen's law. In particular, when the tiny gap is in a certain range, the discharge threshold voltage Vth (V) and the gap d (μm) can be expressed by following formula (1).

$$Vth=6.2\times d+312 \quad 40\leqq d\leqq 120 \ (\mu m) \tag{1}$$

From the above formula, it can be found that the voltage for creating the discharge increases if the tiny gap gets wider. To create the discharge by a high voltage is a status that the energy is large when the discharge occurs. Because most molecules can be ionized, a larger amount of the discharge products, which cause the occurrence of the image stream, are created. In addition, as the tiny gap gets wider, the distance of the gap from the charging roller to the image supporter 1 becomes longer. The space region, where the discharge causes ionization from the charging roller to the image supporter, becomes larger. As a result, the number of the ionized molecules increases, and therefore, a larger amount of the discharge products are created.

According to the above consideration, if the tiny gap is small, the occurrence of the image stream reduces. When the tiny gap is 0, the occurrence of the image stream should be minimal. In fact, when a small tiny gap is arranged, the occurrence frequency of the image stream gets lower. The reason is described as follows.

Figure 5:
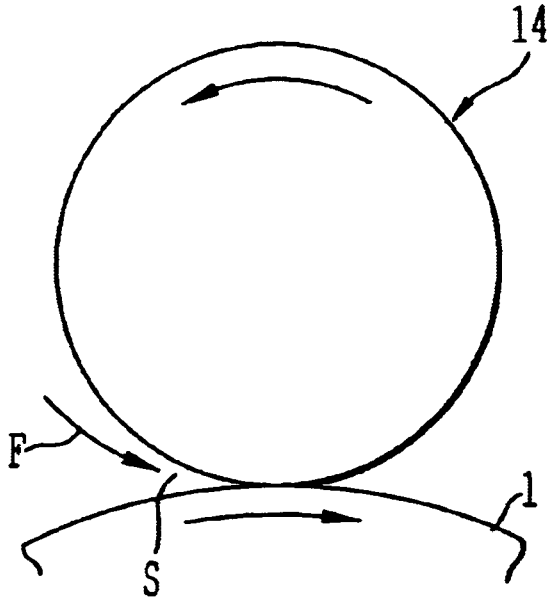
FIG. 5 is a diagram to explain the reasons why the discharge products accumulate on the surface of the image supporter when a contact type charging member is used.

FIG. 5 shows a contact type charging device where the tiny gap between the charging member (made of charging roller) 14 and the image supporter 1 is zero. In the charging device, an air flow F is created by the rotation of the charging member 14 in the wedge region S formed by the image supporter 1 and the charging member 14 at the upstream side. However, because the charging member 14 and the image supporter 1 contact with each other and the tiny gap is zero, the air flow F is stopped by the contact portion of the charging member 14 and the image supporter 1. Considering that the discharge products also move together with the air flow F, since the air flow F is blocked by the contact portion between the charging member 14 and the image supporter 1, the discharge products also become stationary in the vicinity of the contact portion. Therefore, the concentration of the discharge product that exists in the wedge space S rises, and consequnently, the amount of the discharge products accumulated on the surface of the image supporter 1 also increases.

Figure 6:
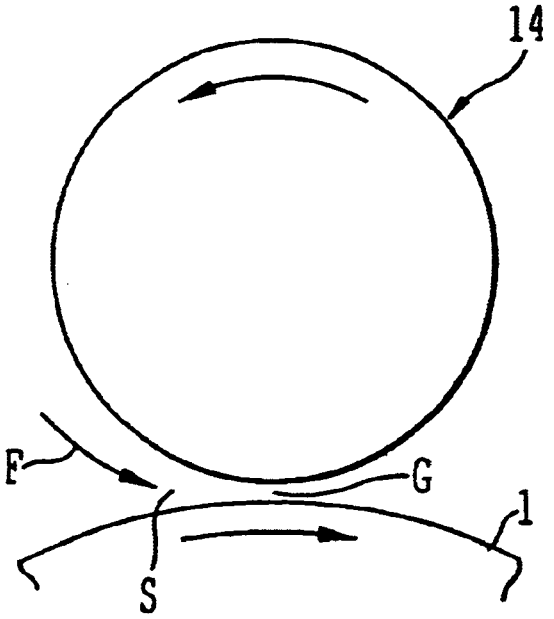
FIG. 6 is a diagram to explain the reasons that the discharge products do not stay when there is a tiny gap formed between the charging member and the surface of the image supporter.

In contrast, as shown in FIG. 6, the tiny gap G exists between the charging member 14 and the image supporter 1. As the tiny gap G increases up to a certain size, the air flow F created by the rotation of the charging member 14 flows through the tiny gap G. Since the discharge products also move together with the air flow F, the discharge products do not stay at the wedge region S, so that the amount of the discharge products accumulated on the image supporter 1 also reduces. As the tiny gap G gets wider, the amount of the air flow F also increases. Therefore, the stationary amount of the discharge products are further decreased, and the amount of the discharge products accumulates on the image supporter 1 is also decreased.

However, as the tiny gap G increases, the discharge voltage increases and the amount of the created discharge products is increased, and therefore, the effect of the air flow F is insufficient. As the tiny gap G exceeds a certain size, the amount of the discharge products accumulated on the surface of the image supporter 1 is increased.

As can be understood from the above description, by setting the tiny gap G between the charging member 14 and the image supporter 1 to a value that the amount of the discharge products accumulated on the image supporter 1 is minimum (about 30 $\mu$m in FIG. 4, or a suitable value next to that value), the occurrence of the aforementioned streamer discharge can be prevented and the amount of the discharge product accumulated on the image supporter 1 can be reduced. Therefore, the spotted abnormal image and the image stream can be prevented.

For the charging member of the conventional charging device, even though the size of the tiny gap is set a suitable value when the image supporter stops, the size of the tiny gap becomes large and deviates from the suitable value, so that the image stream cannot be prevented. Namely, as the image supporter rotates, the external force form the image supporter to the charging member is varied because the surface of the image supporter is slightly waved or the image supporter is acentric, etc. Accordingly, the pressing force of the compressing spring for pressing the charging member against the image supporter varies, and the resistant layer of the charging member is repeatedly pressed with a large deformation. Therefore, the tiny gap cannot be regularly maintained at the suitable value, so that the size of the tiny gap becomes large and deviates from the suitable value periodically.

In the conventional charging device, as the impacting force is applied to the image supporter and the image supporter vibrates from the motor for driving the image supporter, or gears for transmitting the rotation of the motor to the image supporter, etc., the charging member jumps on the surface of the image supporter. In this way, the size of the tiny gap becomes large and deviates from the suitable value.

In the charging device 5 shown in FIGS. 1–3, first, when the image supporter 1 stops rotating, the total load applied from the spacers 18 in perpendicular with the surface of the image supporter 1 is set to a value of 4 N to 25 N (Newton). The total load means that the entire load applied from the spacers 18 to the image supporter 1. The total load refers to a pressing force of the spacers 18 against the image supporter 1, or merely the pressing force.

Referring to FIGS. 1 to 3, the charging member 14 is substantially disposed above the image supporter 1, and the cleaning member 24 is pressed to contact with the charging member 14 by its own weight. Since the charging member 14 is pressed against the surface of the image supporter 1 by an exemplary pressing means such as the compressing spring 21, the pressing force of the spacers 18 against the image supporter 1 is determined by a total sum of the resilient force of the two compressing springs 21, the weight of the charging member 14 itself, and the weight of the cleaning member 24 itself. In the situation that the image supporter 1 stops rotating, the resilient force of the two compressing springs 21, the weight of the charging member 14 itself, and the weight of the cleaning member 24 itself are set in such a manner that the pressing force is within 4 N~25 N.

As described above, by setting the pressing force of the spacers 18 against the image supporter 1 above 4 N, when the image supporter 1 rotates to conduct a discharge operation, even though an impacting force applies to the image supporter 1, the charging member 14 can be prevented from jumping on the surface of the image supporter 1, so that a large variation of the tiny gap G can be avoided.

In addition, by setting the pressing force of the spacers 18 against the image supporter 1 under 25 N, an extra large force can be avoided from applying onto the image supporter 1 and the charging member 14. The degradation of the image supporter 1 and the charging member 14 at the beginning can be prevented and therefore, the lifetime can be extended.

Figure 7:
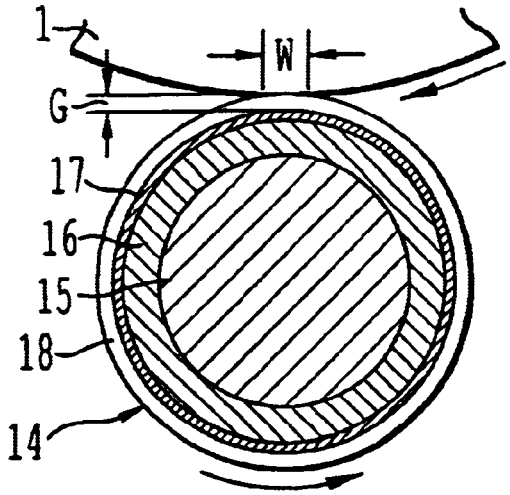
FIG. 7 shows an installation position of the charging member with respect to the image supporter, which is different from the image forming device shown in FIG. 1.

The position for installing the charging member 14 with respect to the image supporter 1 can be suitably set, and additionally, as described above, the cleaning member 24 for the charging member 14 can be omitted. In FIG. 7, the cleaning member for the charging member is not installed and the charging member 14 is disposed under the image supporter 1. By a pressing means made of a compressing string (not shown), the spacers 18 of the charging member 14 is pressed to contact with the image supporter 1, similar to those shown in FIGS. 1 to 3. In this situation, the pressing force created by the compressing springs minus the weight of the charging member 14 itself becomes the pressing force of the spacers 18 against the image supporter 1, this force is set at about 4 N~25 N.

In the charging device 5 shown in FIGS. 1 to 3, when the pressing force of the spacers 18 against the image supporter 1 is set within the above range, in the situation that the image supporter 1 stops, the charging member 14 is constructed in such a manner that the contact width W (see FIG. 3) of the contact portion where the spacers 18 are pressed to contact with image supporter 1 in the moving direction of the surface of the image supporter 1 is below 0.5 mm (same as the example in FIG. 7). The base body 15, the resistant layer 16, the surface layer 17, and the spacer s 18 are constructed in such a manner that the contact width is below 0.5 mm. By using this structure, even though the external force, which is applied to the charging member due to the waved surface or acentricity of the rotating image supporter 1, is varied and accordingly the pressing force imparting to the charging member 14 from the image supporter 1 by its acentricity is varied, a large variation of the tiny gap G can be avoided.

As described above, if the charging member 14 is formed in such a manner that the load magnitude applied in perpendicular to the image supporter 1 from the spacers 18 is set within a range of 4 N to 25 N, and the contact width W of the of the contact portion where the spacers 18 are pressed to contact with image supporter 1 in the moving direction of the surface of the image supporter 1 is below 0.5 mm, the tiny gap G can be regularly maintained within a suitable range during the image formation process by setting the tiny gap G to a value that the occurrence of the image stream is minimized, or near that value, for example, the value can be 10 to 60 $\mu$m, or particularly, 20–50 $\mu$m. In this way, the occurrence of the image stream can be avoided or effectively suppressed, so that a high quality image can be obtained. Additionally, in the foregoing experiment, the charging roller with a contact width below 0.5 mm is used.

By forming the charging member 14 where the contact widths W of the spacers 18 are below 0.5 mm, a lot of experiments can confirm the result that the variation of the tiny gap G can be suppressed, and an example is described set forth as follows.

Figure 8:
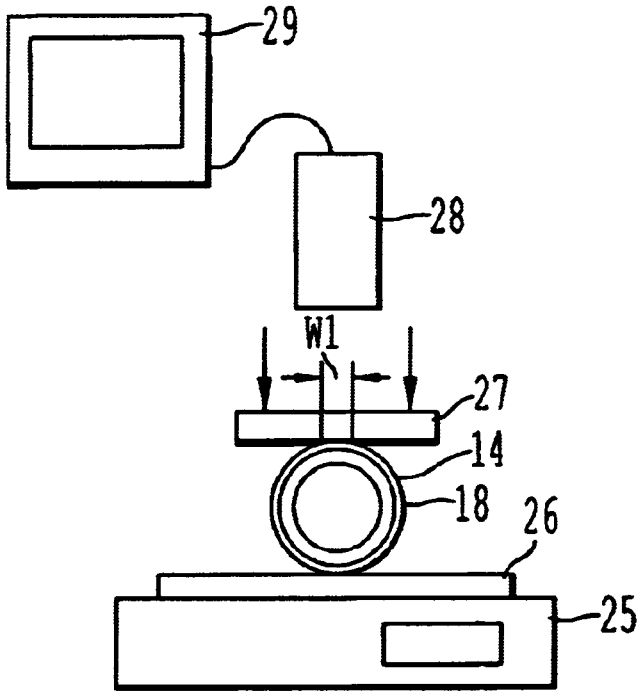
FIG. 8 schematically shows an experiment device for the charging member.

FIG. 8 is a schematic diagram showing a device used in the experiment. The shape of the charging member 14 used in the experiment is the same as that shown in FIGS. 2 and 3. The resistant layer 16 of the first charging member 14 used in the experiment is made of hard resin. As a comparative example, the resistant layer 16 of the second charging member 14 is made of soft rubber whose elastic deformation occurs easily than the hard resin. The spacers 18 of the charging member 14 are made of tape.

As shown in FIG. 8, the first and the second charging members are respectively put on a balance 25 to make the spacers 18 to contact with the stage 26 of the balance 25. Next, a transparent glass plate 27 is put on each charging member 14 to make the glass plate 27 to contact with the spacers 18, and then the glass plate 27 is pressed downwards. At this time, the contact width W1 of the contact portion between the spacers 18 and the glass plate 27 is enlarged to observe by using a microscope 28 connected to a computer 29, so as to measure the contact width W1. The pressing force against the glass plate 27, i.e., the pressing force of the spacers 18 against the glass plate 27 is set 7.84 N and 19.6 N respectively, which is measured by the balance 25.

As a result, for the first charging member 14, in any of the conditions that the pressing force applied against the glass plate 27 is 7.84 N and 19.6 N, the contact width W1 is 0.3 mm. In contrast, for the second charging member 14, the contact width W1 is 0.8 mm and 1.2 mm when the pressing force is 7.84 N and 19.6 respectively.

From the above experiment, as shown in FIG. 3, if the charging member 14 is constructed in such a manner that the contact width W is below 0.5 mm when the image supporter 1 stops rotating, even though the pressing force of the spacers 18 against the image supporter 1 is varied accompanying with the rotation of the image supporter 1, the contact width W almost does not change. During the rotation of the image supporter 1, even though the pressing force applied to the charging member 14 by the compressing spring 21 varies, the tiny gap G between the charging member 14 and the surface of the image supporter 1 does not change. When the base body 15 and the resistant layer 16 are formed in such a manner that the contact width W is larger than 0.5 mm, or particularly larger than 1 mm, the contact width W varies greatly because of the variation of the pressing force against the charging member 14 caused by the compressing strings 21 during the rotation of the image supporter 1.

As described above, the magnitude of the total load applied from the spacers 18 in perpendicular to the surface of the image supporter 1 is set within a suitable range of 4 N~25 N, but preferably, the magnitude of the total load is set within a suitable range of 6 N~15 N. When the image supporter 1 stops, the spacers 18 is constructed to be in contact with the image supporter 1 within a range of 6 N to 15 N.

As the gears of the driving system of the image supporter 1 degrades obviously with time, an impacting force with an unexpected large amplitude might be applied to the image supporter 1. At this time, as described above, if the pressing force is set above 6 N, even though n impacting force with an unexpected large amplitude might be applied to the image supporter 1, the charging member 14 can be prevented from jumping on the image supporter 1. Therefore, large variation of the tiny gap G between the image supporter 1 and the charging member 14 can be avoided.

On the other hand, by setting the pressing force below 15 N, damage to the surface of the image supporter 1 with time or the degradation of the charging member 14 can be further suppressed effectively, so that the life time can be firmly extended.

In addition, as could be learned from FIG. 4, if the tiny gap G between image supporter 1 and the charging member 14 when the image supporter 1 stops is set 20 $\mu$m–50 $\mu$m, the occurrence of the image stream can be effectively avoided, so that a high quality image can be obtained.

Next, materials for each member of the charging member 14 are exemplified. The tape material forming the spacers 18 can be metal such as aluminum, iron, nickel and their oxide; metal alloy such as Fe—Ni alloy, stainless steel, Co—Al alloy, nickel steel, duralumin, monel, inconel, etc. metal alloy; olefin resin such as polyethylene (PE), polypropylene (PP), etc.; polyester resin such as polyethyleneterephthalate (PET), polybutyleneterephthalate (PBT), etc.; fluorine resin, such as polytetrafluoroethylene (PTFE) and its co-polymer (such as PFA, FEP); and polyimide resin, etc. In particular, it is preferred to use a material with a high mold-releasing ability that the toner is difficult to adhere thereon. In addition, when a conductive material is used as the tape, an insulating layer or a half-resistant body layer is coated on the surface of the tape to insulate the tape (the spacer 18) from the image supporter 1.

The resistant layer 16 is formed by a base material and a conductive agent dispersed in the base material. The base material can use general resin with a good workability, for example, olefin resin such as polyethylene (PE), polypropylene (PP); styrene resin such as polystyrene and its co-polymer (AS, ABS); and acryl resin such as poly methyl methacrylate (PMMA).

The conductive agent of the resistant layer 16 can be alkali metal salt such as lithium peroxide; perchlorate such as sodium perchlorate, quadru-ammonium salt such as tetrabutyl ammonium salt, ion conductive agent such as polymer conductive agent. In addition, carbon black such as ketjenblack, acetylene black can be also used.

The surface layer is also formed by a material dispensing conductive agent to a base material. The base material can use suitable material such as fluorine resin, silicon resin, acryl resin, polyamide resin, polyester resin, polyvinyl butyral resin, polyurethane, etc. In particular, it is preferred to use a material that the toner is difficult to adhere thereon.

The conductive material of the surface layer can be carbon black such as ketjenblack, acetylene black; electron conductive metal oxide such as indium oxide, tin oxide etc; or other suitable conductive agent.

The charging voltage applied to the charging member 14 can be only the DC voltage. However, as described in the previous experiment, it is preferred to apply a charging voltage that an AC voltage is overlapped to a DC voltage. When the electric resistance within the current passage formed by the resistant layer 16 and the surface layer 17 of the charging member 14 is not uniform, if only the DC voltage is applied to the charging member 14, the charged potential of the image supporter 1 might be not uniform. However, if the charging voltage that the AC voltage is overlapped to the DC voltage is applied to the charging member 14, the surface of the charging member 14 is equipotential and the discharge is stable, so that the surface of the image supporter 1 can be uniformly charged.

At this time, it is particularly preferred that the voltage between peaks of the AC voltage applied to the charging member 14 is set more than two times of the initial charging voltage of the image supporter 1. In this way, the discharge from the image supporter 1 to the charging member 14, i.e., a reverse discharge occurs. Even though the electric resistance within the current passage of the charging member 14 is not uniform, the image supporter 1 can be uniformly charged to a more stable status. When only the DC voltage is applied to the charging member 14 and the absolute value of the applied voltage increases gradually, the initial charging voltage is the absolute value of a voltage when the surface of the image supporter 1 begins to be charged. In addition, if necessary, the DC voltage can correspond to a DC voltage that is under constant current control.

Figure 9:
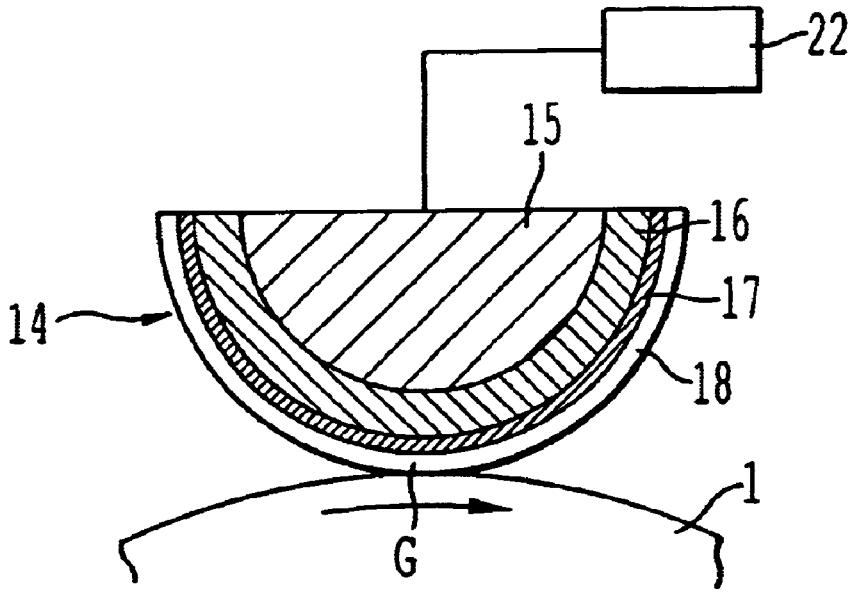
FIG. 9 is a cross-sectional side view showing another exemplary charging member.

FIG. 9 shows a charging member 14 formed in a semi-cylindrical shape. The charging member 14 has a shape that the charging member 14 in FIGS. 1 to 3 and 7 is divided into half, and is fixedly installed without rotation. The other structures are same as the charging member 14 shown in FIGS. 1–3 and 7, and the same parts are labeled with the same numbers in FIG. 3.

The charging member can be formed in any suitable structure. However, as the charging member 14 shown in FIGS. 3, 7 and 9, a surface of the charging member 14 opposite to a discharge region is a curve that is gradually separated from the surface of the image supporter 1, from a nearest portion with respect to the surface of the image supporter 1 to an upstream and a downstream sides in the moving direction of the surface of the image supporter 1, respectively. In this way, the surface of the image supporter 1 can be more uniformly charged. If an acute portion exists on the surface of the charging member 14 opposite to the discharge region, the abnormal discharge at that portion, so that it is difficult to charge the image supporter 1 uniformly. However, as the charging member 14 shown in FIGS. 3, 7 and 9, when the surface of the charging member 14 opposite to the surface of the image supporter 1 is formed in a curve shape, the abnormal discharge can be suppressed and the image supporter 1 can be uniformly charged.

At this time, the surface acted by the discharge of the charging member 14 is subject to a strong stress due to the discharge. Therefore, as the charging member 14 is disposed without moving as shown in FIG. 9, since the discharge always occurs at the same surface of the charging member 14, the degradation is accelerated, so that the surface of the charging member 14 might be chipped off. In this situation, the tiny gap G cannot be maintained between the charging member 14 and the surface of the image supporter 1 and therefore, the amount of the discharge products adhered on the image supporter 1 increases.

In contrast, as shown in FIGS. 1–3 and 7, when the charging member 14 is formed by a rotating charging roller, since the entire peripheral surface is used as the discharge surface, the charging member 14 can be prevented from degrading at the early stage and the tiny gap G can be definitely maintained for a long time. In this way, for a long time use, the image stream can be avoided.

In the image forming device as shown in FIG. 1, the cleaning device 12 for cleaning up the surface of the image supporter 1 is installed, by which the residual toner can be removed. However, very little amount of toner might pass through the cleaning device 12 and then enter to between the charging member 14 and the surface of the image supporter 1. At this time, if the tiny gap G is narrower than the grain size of the toner, since it is not possible for the toner to pass through the tiny gap G, a stress acts against the toner, so that the toner might deform by heat and is melted onto the surface of the charging member 14. In this situation, abnormal discharge occurs easily.

Therefore, it is preferred that the tiny gap G is set to a value larger than the toner grain size of the toner image formed on the surface of the image supporter 1. In this manner, the toner passing through the cleaning device 12 can also pass through the tiny gap G directly and the toner is not melted onto the surface of the charging member 14. Thereby, the abnormal discharge caused by the toner melt can be avoided.

In addition, when a two-component developer is used in the developing device 7 as shown in FIG. 1, the carrier adheres on the surface of the image supporter 1 and then passes through the cleaning device 12 to reach the tiny gap G. At this time, as the tiny gap G is narrower than the grain size of the carrier, the toner is not possible to pass through the tiny gap G. However, since the carrier in general is made of hard material such as the iron powder, when the carrier passes through the tiny gap G, the surfaces of the charging member 14 and the image supporter 1 might be damaged. As the surface of the charging member 14 is damaged, protrusion portion can be formed on the surface of the charging member 14, which causes the abnormal discharge. In addition, as the surface of the image supporter 1 is damaged, the damage appears on the image, by which not only is the image quality reduced, the electric field is concentrated at the damage portion of the image supporter 1 to cause the abnormal discharge.

It is preferred that the tiny gap G is set to a value larger than the grain size of the carrier of the developer used in the developing device to form the toner image on the surface of the image supporter 1. In this manner, the above inconvenience and drawbacks can be avoided and therefore, the image supporter 1 can be uniformly charged.

As micro particles such as the dust or the toner are adhered on the surface of the charging member 14, the electric field is concentrated at the portion where the micro particles adhere thereon and the abnormal discharge occurs. In addition, as insulating particles adhere on the surface of the charging member 14 over a very wide range, the discharge does not occur at the adhesion portion. Therefore, uneven charged surface of the image supporter 1 occurs.

In order to prevent this drawback, as described above, the cleaning member 24 for cleaning up the surface of the charging member 14 is installed in the charging device 5 shown in FIG. 1. The cleaning member 24 cleans up the peripheral surface of the charging member 14. Therefore, even though the micro particles such as the toner adhere on the surface of the charging member 14, these micro particles can be immediately removed to avoid the aforementioned drawback and inconvenience.

In addition, since the c leaning member 24 is rotatably supported by the casing 23 of the charging device 5, the contact area between the cleaning member 24 and the surface of the charging member 14 becomes larger due to the rotation of the cleaning member 24, so that the charging member 14 can be more effectively cleaned up. The cleaning member 24 can be also fixed without moving. However, if doing so, only a particular location of the cleaning member 24 is always in contact with the charging member, the cleaning performance might be reduced at the early stage. By rotating the cleaning member 24, this inconvenience can be avoided.

Figure 10:
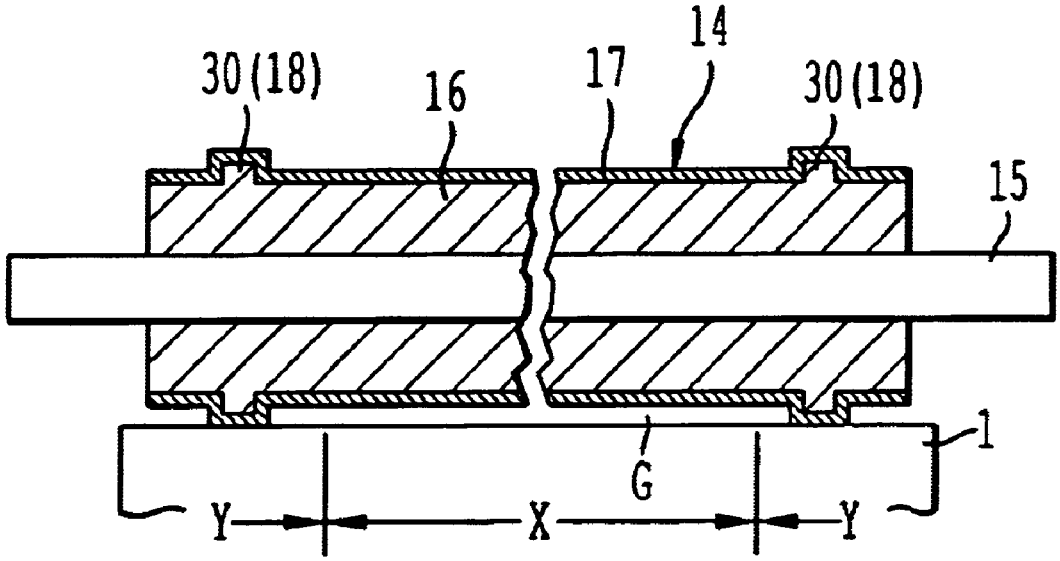
FIG. 10 is a vertical cross-sectional view showing another exemplary spacers of the charging member.

In the charging member 14 shown in FIGS. 3, 7 and 9, the spacers 18 are formed by winding tape on the charging member 14, but the spacers 18 can be also formed by any other suitable method. For example, when making the charging member 14, the surface of the resistant layer 16 is cut. At this time, as shown in FIG. 10, ring protrusions 30 are formed on the each end portion of the resistant layer 16 in the longitudinal direction, in which the spacers 18 are formed by the protrusions 30, and the spacers 18 are pressed to contact with the non-image forming region Y of the image supporter 1. In the example shown in FIG. 10, the surface layer 17 is further deposited on the surface of the resistant layer 16. The resistant layer 16 is opposite to the surface of the image supporter 1 through the surface layer 17, but can also be omitted. As described, the charging member 14 comprises the conductive base body 15 where the charging voltage is applied thereon, and the resistant layer 16 that is fixed on the base body 15, wherein the resistant layer 16 is made opposite to the surface of the image supporter 1, protrusions 30 protruding to the surface of the image supporter 1 are formed on the resistant layer that is not opposite to the image forming region X of the image supporter 1, and the spacers 18 are formed by the protrusions 30.

Figure 11:
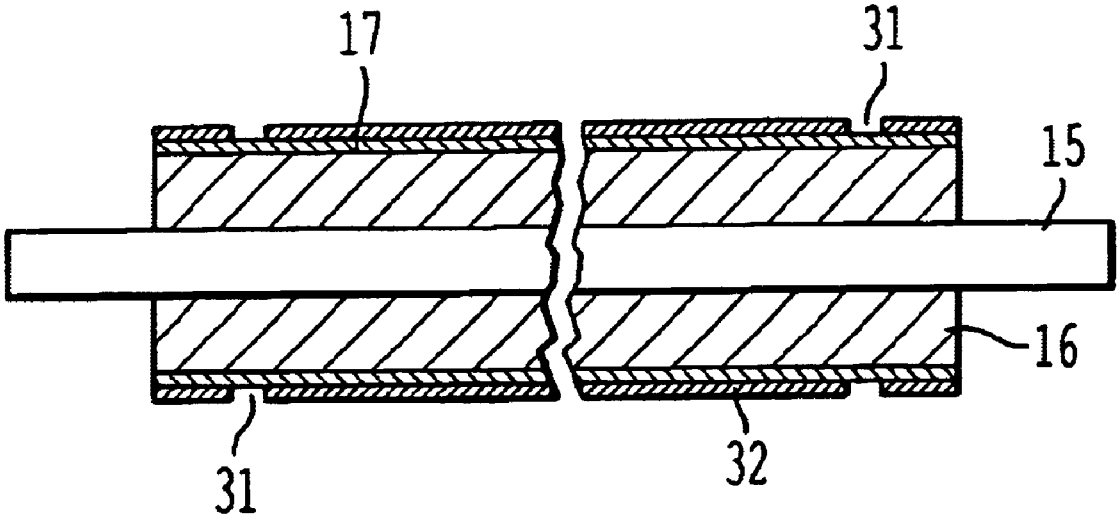
FIG. 11 is a vertical cross-sectional view showing a method for forming spacers of another embodiment.
Figure 12:
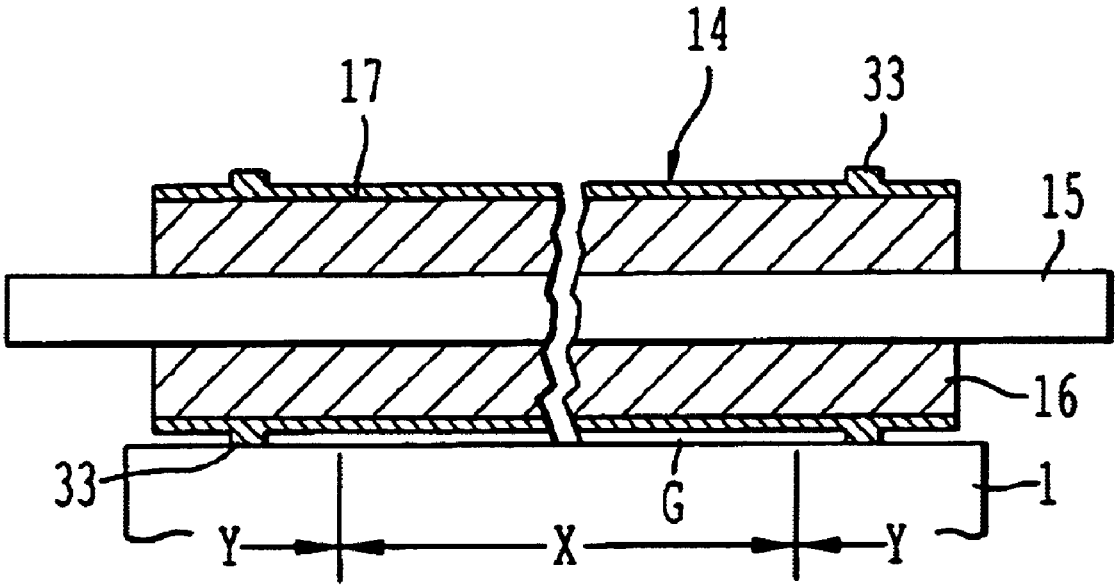
FIG. 12 is a cross-sectional view of the charging member with the spacers formed by the method shown in FIG. 11.

In addition, the charging member 14 shown in FIG. 3, 7 and 9 comprises a surface layer 17, and the spacers 18 can also be formed by thickening the thickness of the surface layer 17 locally. FIGS. 11 and 12 show exemplary methods for forming the spacers. First, as shown in FIG. 11, a charging member, which comprises the conductive base body 15 where the charging voltage is applied thereon, the resistant layer 16 that is fixed on the base body 15, and the surface layer 17 deposited on the resistant layer, is manufactured. The surface layer 17 can be coated by spraying a surface layer material on the outer peripheral surface. Next, as shown in FIG. 11, a masking member 32 with ring gaps 31 at two positions is covered on the outer peripheral surface of the resistant layer 16, and then the surface layer material is further sprayed on the gaps 31. After getting hard, the masking member 32 is removed to complete the charging member 14 where the thickness of the surface layer 17 at the two portions 33 is thickened as shown in FIG. 12. Then, the surface layer 17 is made to be opposite to the surface of the image supporter 1 and the thicker portions 33 are used as the spacers 18 to be pressed to contact with the non-image forming region Y of the image supporter 1. In this manner, the thickness of the portions 33 other than the surface layer portion opposite to the image forming region X is thicker than the thickness of the surface layer opposite to the image forming region X. The spacers 18 are formed by forming thicker surface layer portions 33.

The protrusions 30 are formed on the resistant layer 16 as shown in FIG. 10, and the portions 33 of the surface layer 17 are thickened as shown in FIG. 12, so as to form the spacers 18. Namely, the spacers 18 can be formed by the protrusions 30 and the portions 33.

In the above examples, the charging member 14 comprises the conductive base body, the resistant layer 16 that is fixed on the base body 15, and the surface layer 17 deposited on the resistant layer. The surface layer 17 is opposite to the image supporter 1, and the surface layer 17 is used to increase the stability of the discharge and to protect the charging member 14. This surface layer 17 can be omitted. However, as described above, when the surface layer 17 is formed, it is better that the surface layer 17 comprises a base material and an electron conductive agent dispensed in the base material. If the charging member 14 with the surface layer 17 is used, since the electron conductive surface layer 17 can suppress the water from going in and out the inside of the charging member 14 in a low or high humidity environment, the resistance variation of the charging member 14 can be suppressed. Therefore, even though the environment changes, the variation of the charging potential on the surface of the image supporter I can be reduced.

At this time, as described above, it is preferred that the volume resistance rate of the surface layer 17 is set higher than the volume resistance rate of the resistant layer 16. If the resistance of the surface layer is low, the surface resistance rate is reduced, so that a current passage is formed on the surface of the charging member and the current flows in the axial direction of the charging member 14. Thereby, the discharge energy is not uniform at the gap and the discharge occurs concentratively, so that streamer discharge might occur. By increasing the volume resistance rate of the surface layer 17 higher than the volume resistance rate of the resistant layer, the discharge is uniform and the aforementioned abnormal discharge can be avoided since the current passage to the surface direction of the charging member can be prevented from occurring.

The volume resistance rate of the resistant layer 16 is set from $10^5$ Ω·m to $10^9$Ω·m. If the volume resistance rate is higher than $10^9$ Ω·m, the discharge is insufficient and therefore, the surface of the image supporter 1 cannot be sufficiently charged. In contrast, if the volume resistance rate is lower than $10^5$ Ω·m, defects such as the pinholes occurs on the photoreceptive layer of the image supporter 1. As a result, discharge current concentrates at the pinholes and the abnormal discharge occurs. Furthermore, an over current makes the pinholes to enlarge and the photoreceptive layer might be damaged.

In the image forming device shown in FIG. 1, the casing 23 rotatably supporting the charging member 14 and the cleaning case 10 of the cleaning device 12 are integrally formed as a unit case 34. The image supporter 1 is rotatably installed to the unit case 34. In this manner, the unit case 34 and the image supporter 1 are integrally formed as an image forming unit 35. The image forming unit 35 is detachable from the main body of the image forming device. The charging member 14 and the image supporter 1 is installed into the unit case 34 in such a manner that a constant tiny gap G is maintained. With the tiny gap being kept constant, the image forming unit 35 can be detachable from the main body of the image forming device. Therefore, when attaching or detaching the image forming unit 35, large variation of the size of the tiny gap G can be prevented. The image supporter 1 and the charging member 14 can also be respectively attached to or detached from the main body of the image forming device. However, if doing so, the tiny gap G might vary when attaching/detaching the image supporter 1 or the charging member 14. Therefore, a lot of discharge products might adhere on the surface of the image supporter 1 when the image formation process is operated.

In addition to the charging member 14, the image forming unit 35 further comprises the contact member to be in contact with the image supporter 1. In the example shown in FIG. 1, the cleaning case 10 and the casing 23 are integrally formed as the unit case 23, and the cleaning blade 11 and the fur brush 13 are installed within the unit case 10. These members, the cleaning blade 11 and the fur brush 13, form the contact member to contact with the image supporter 1. The contact member can also be respectively attached to or detached from the main body of the image forming device, independent of the charging member 14. However, if doing so, when detaching the contact member, a large external force is applied on the image supporter 1 since the contact member is moved in contact with the image supporter 1. In this way, the tiny gap G might vary. In contrast, if the contact member is also as the main element of the image forming unit 35, when the image forming unit is attached to or detached from the main body of the image forming device, the contact member does not move relatively to the image supporter 1 since the contact member consisting of cleaning blade 11 and the fur brush 13 are simultaneously attached to or detached from the main body of the image forming device. In this way, the tiny gap G does not vary greatly.

The image forming device as shown in FIG. 1 comprises the charging device 5 having the aforementioned structure and the image supporter 1. However, at this time, if the surface of the image supporter 1 is a largely waved and has a rough surface, even though each element uses the above structure, the tiny gap G varies easily when the image supporter 1 rotates. Therefore, it is preferred that the image supporter 1 is a photoreceptor structure having an amorphous silicon surface layer. In this way, since the surface of the image supporter 1 is extremely smoothened, the variation of the size of the tiny gap G can be effectively suppressed and the effect of the above charging device structure can be more effectively achieved.

Additionally, for example, if the image supporter is formed as a photoreceptor that has a surface layer in which filler such as aluminum powder with a size below 0.1 μm, since the surface hardness is increased and the abrasion proof ability can be improved, the life time can be largely extended.

The charging device with each structure described can be also widely adopted in an image forming device other than the structure shown in FIG. 1. For example, in a well-known conventional color image forming device, a plurality of image supporters (for example, four entities) where toner images with different colors are respectively formed thereon are arranged therein, and the toner images respectively formed on each image supporter are overlapped to transfer onto a transfer material in sequence. In order to charge each image supporter of the color image forming device, the aforementioned charging device according to the present invention can be used.

According to the present invention, the large variation of the tiny gap G between the charging member and the surface of the image supporter during the image forming operation can be avoided, and therefore, a high quality toner image can be formed on the image supporter.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A charging device, comprising:

a charging member, disposed opposite to a surface of an image supporter and pressed against the image supporter, wherein a charging voltage is applied to the charging member to discharge between the charging member and the surface of the image supporter, so as to charge the image supporter, and wherein the charging member further comprises spacers in contact with a portion other than an image forming region of the image supporter, and a portion of the charging member opposite to the image forming region of the image supporter separates from the surface of the image supporter by a tiny gap, and wherein a magnitude of a total load applied in perpendicular to the surface of the image supporter from the spacers is set at 4 N to 25 N (Newton), and in a moving direction of the surface of the supporter, a contact width of a contact portion where the spacer is pressed to contact with the image supporter is set below 0.5 mm.

2. The charging device of claim 1, wherein the magnitude of the total load is preferably set 6 N to 15 N.

3. The charging device of claim 1, wherein the tiny gap is set at 20–50 μm.

4. The charging device of claim 1, wherein the charging voltage where an AC voltage is overlapped to a DC voltage is applied to the charging member.

5. The charging device of claim 4, wherein a voltage between peaks of the AC voltage applied to the charging member is set more than two times of an initial charging voltage of the image supporter.

6. The charging device of claim 1, wherein a surface of the charging member opposite to a discharge region is a curve that is gradually separated from the surface of the image supporter, from a nearest portion with respect to the surface of the image supporter to an upstream and a downstream sides in the moving direction of the surface of the image supporter, respectively.

7. The charging device of claim 6, wherein the charging member is formed in a cylindrical shape.

8. The charging device of claim 7, wherein the charging member is a rotatable roller.

9. The charging device of claim 1, wherein the tiny gap is set larger than a toner grain size of a toner image formed on the image supporter.

10. The charging device of claim 1, wherein the tiny gap is set larger than a grain size of a carrier in a developer used in a developing device that is to form the toner image on the surface of the image supporter.

11. The charging device of claim 1, further comprising a cleaning member for cleaning up the surface of the charging member.

12. The charging device of claim 11, wherein the cleaning member is rotationally supported.

13. The charging device of claim 1, wherein the charging member further comprises:

a conductive base body where the charging voltage is applied thereon; and a resistant layer fixed on the conductive base body, wherein protrusions are formed on a portion of the resistant layer other than the portion opposite to the image forming region of the image supporter, to protrude towards the surface of the image supporter, and the spacers are formed by the protrusions.

14. The charging device of claim 1, wherein the charging member further comprises:

a conductive base body where the charging voltage is applied thereon;

a resistant layer fixed on the conductive base body; and a surface layer, deposited on the resistant layer, wherein a thickness of a surface portion where the surface layer not opposite to the image forming region of the image supporter is thicker than that of a surface portion where the surface layer is opposite to the image forming region of the image supporter, and the spacers are formed by the thicker surface portion of the surface layer.

15. The charging device of claim 1, wherein the charging member further comprises:

a conductive base body where the charging voltage is applied thereon;

a resistant layer fixed on the conductive base body; and a surface layer, deposited on the resistant layer, wherein the surface layer comprises a base material and an electron conductive agent.

16. The charging device of claim 14, wherein a volume resistance rate of the surface layer is set higher than that of the resistant layer.

17. The charging device of claim 15, wherein a volume resistance rate of the surface layer is set higher than that of the resistant layer.

18. A charging device, comprising:

a charging member, disposed opposite to a surface of an image supporter and pressed against the image supporter, wherein a charging voltage is applied to the charging member to discharge between the charging member and the surface of the image supporter, so as to charge the image supporter, and wherein the charging member further comprises spacers in contact with a portion other than an image forming region of the image supporter, and a portion of the charging member opposite to the image forming region of the image supporter separates from the surface of the image supporter by a tiny gap, and wherein in a moving direction of the surface of the supporter, a contact width of a contact portion where the spacer is pressed to contact with the image supporter is set below 0.5 mm.

19. The charging device of claim 18, wherein the charging voltage where an AC voltage is overlapped to a DC voltage is applied to the charging member.

20. The charging device of claim 19, wherein a voltage between peaks of the AC voltage applied to the charging member is set more than two times of an initial charging voltage of the image supporter.

21. The charging device of claim 18, wherein a surface of the charging member opposite to a discharge region is a curve that is gradually separated from the surface of the image supporter, from a nearest portion with respect to the surface of the image supporter to an upstream and a downstream sides in the moving direction of the surface of the image supporter, respectively.

22. The charging device of claim 21, wherein the charging member is formed in a cylindrical shape.

23. The charging device of claim 22, wherein the charging member is a rotatable roller.

24. The charging device of claim 18, wherein the tiny gap is set below 100 $\mu$m.

25. The charging device of claim 18, wherein the tiny gap is set larger than a toner grain size of a toner image formed on the image supporter.

26. The charging device of claim 18, wherein the tiny gap is set larger than a grain size of a carrier in a developer used in a developing device that is to form the toner image on the surface of the image supporter.

27. The charging device of claim 18, further comprising a cleaning member for cleaning up the surface of the charging member.

28. The charging device of claim 27, wherein the cleaning member is rotationally supported.

29. The charging device of claim 18, wherein the charging member further comprises:

a conductive base body where the charging voltage is applied thereon; and a resistant layer fixed on the conductive base body, wherein protrusions are formed on a portion of the resistant layer other than the portion opposite to the image forming region of the image supporter, to protrude towards the surface of the image supporter, and the spacers are formed by the protrusions.

30. The charging device of claim 18, wherein the charging member further comprises:

a conductive base body where the charging voltage is applied thereon;

a resistant layer fixed on the conductive base body; and a surface layer, deposited on the resistant layer, wherein a thickness of a surface portion where the surface layer is not opposite to the image forming region of the image supporter is thicker than that of a surface portion where the surface layer is opposite to the image forming region of the image supporter, and the spacers are formed by the thicker surface portion of the surface layer.

31. The charging device of claim 18, wherein the charging member further comprises:

a conductive base body where the charging voltage is applied thereon;

a resistant layer fixed on the conductive base body; and a surface layer, deposited on the resistant layer, wherein the surface layer comprises a base material and a electron conductive agent.

32. The charging device of claim 30, wherein a volume resistance rate of the surface layer is set higher than that of the resistant layer.

33. The charging device of claim 31, wherein a volume resistance rate of the surface layer is set higher than that of the resistant layer.

34. An image forming unit, comprising:

a charging member, disposed opposite to a surface of an image supporter and pressed against the image supporter, wherein a charging voltage is applied to the charging member to discharge between the charging member and the surface of the image supporter, so as to charge the image supporter, and wherein the charging member further comprises spacers in contact with a portion other than an image forming region of the image supporter, and a portion of the charging member opposite to the image forming region of the image supporter separates from the surface of the image supporter by a tiny gap, and wherein in a moving direction of the surface of the supporter, a contact width of a contact portion where the spacer is pressed to contact with the image supporter is set below 0.5 mm; and an image supporter, wherein the image supporter and the charging member are integrally installed, and capable of detaching from or attaching to a mainbody of an image forming device.

35. The charging device of claim 34, wherein a magnitude of a total load applied perpendicular to the surface of the image supporter from the spacers is set at 4 N to 25 N (Newton).

36. The charging device of claim 34, wherein the magnitude of the total load is preferably set at 6 N to 15 N.

37. The charging device of claim 34, wherein the tiny gap is set 20–50 $\mu$m.

38. The charging device of claim 34, wherein the charging voltage where an AC voltage is overlapped to a DC voltage is applied to the charging member.

39. The charging device of claim 38, wherein a voltage between peaks of the AC voltage applied to the charging member is set more than two times of an initial charging voltage of the image supporter.

40. The charging device of claim 34, wherein a surface of the charging member opposite to a discharge region is a curve that is gradually separated from the surface of the image supporter, from a nearest portion with respect to the surface of the image supporter to an upstream and a downstream sides in the moving direction of the surface of the image supporter, respectively.

41. The charging device of claim 40, wherein the charging member is formed in a cylindrical shape.

42. The charging device of claim 41, wherein the charging member is a rotatable roller.

43. The charging device of claim 34, wherein the tiny gap is set below 100 $\mu$m.

44. The charging device of claim 34, wherein the tiny gap is set larger than a toner grain size of a toner image formed on the image supporter.

45. The charging device of claim 34, wherein the tiny gap is set larger than a grain size of a carrier in a developer used in a developing device that is to form the toner image on the surface of the image supporter.

46. The charging device of claim 34 further comprising a cleaning member for cleaning up the surface of the charging member.

47. The charging device of claim 46, wherein the cleaning member is rotationally supported.

48. The charging device of claim 34, wherein the charging member further comprises:

a conductive base body where the charging voltage is applied thereon; and a resistant layer fixed on the conductive base body, wherein protrusions are formed on a portion of the resistant layer other than the portion opposite to the image forming region of the image supporter, to protrude towards the surface of the image supporter, and the spacers are formed by the protrusions.

49. The charging device of claim 34, wherein the charging member further comprises:

a conductive base body where the charging voltage is applied thereon;

a resistant layer fixed on the conductive base body; and a surface layer, deposited on the resistant layer, wherein a thickness of a surface portion where the surface layer is not opposite to the image forming region of the image supporter is thicker than that of a surface portion where the surface layer is opposite to the image forming region of the image supporter, and the spacers are formed by the thicker surface portion of the surface layer.

50. The charging device of claim 34, wherein the charging member further comprises:

a conductive base body where the charging voltage is applied thereon;

a resistant layer fixed on the conductive base body; and a surface layer, deposited on the resistant layer, wherein the surface layer comprises a base material and an electron conductive agent.

51. The charging device of claim 49, wherein a volume resistance rate of the surface layer is set higher than that of the resistant layer.

52. The charging device of claim 50, wherein a volume resistance rate of the surface layer is set higher than that of the resistant layer.

53. The image forming unit of claim 34, further comprising a contact member that is in contact with the image supporter.

54. An image forming device, comprising:

a charging device, equipped with a charging member, disposed opposite to a surface of an image supporter and pressed against the image supporter, wherein a charging voltage is applied to the charging member to discharge between the charging member and the surface of the image supporter, so as to charge the image supporter, and wherein the charging member further comprises spacers in contact with a portion other than an image forming region of the image supporter, and a portion of the charging member opposite to the image forming region of the image supporter separates from the surface of the image supporter by a tiny gap, and wherein in a moving direction of the surface of the supporter, a contact width of a contact portion where the spacer is pressed to contact with the image supporter is set below 0.5 mm; and an image supporter.

55. The image forming device of claim 54, wherein a magnitude of a total load applied in perpendicular to the surface of the image supporter from the spacers is set at 4 N to 25 N (Newton).

56. The image forming device of claim 54, wherein the image supporter is formed as a photoreceptor having a surface layer made of amorphous silicon.

57. The image forming device of claim 54, wherein the image supporter is formed as a photoreceptor having a surface layer where fillers are dispensed therein.

58. The charging device of claim 54, wherein the magnitude of the total load is preferably set at 6 N to 15 N.

59. The charging device of claim 54, wherein the tiny gap is set at 20–50 $\mu$m.

60. The charging device of claim 54, wherein the charging voltage where an AC voltage is overlapped to a DC voltage is applied to the charging member.

61. The charging device of claim 60, wherein a voltage between peaks of the AC voltage applied to the charging member is set more than two times of an initial charging voltage of the image supporter.

62. The charging device of claim 54, wherein a surface of the charging member opposite to a discharge region is a curve that is gradually separated from the surface of the image supporter, from a nearest portion with respect to the surface of the image supporter to upstream and downstream sides in the moving direction of the surface of the image supporter, respectively.

63. The charging device of claim 62, wherein the charging member is formed in a cylindrical shape.

64. The charging device of claim 63, wherein the charging member is a rotatable roller.

65. The charging device of claim 54, wherein the tiny gap is set below 100 $\mu$m.

66. The charging device of claim 54, wherein the tiny gap is set larger than a toner grain size of a toner image formed on the image supporter.

67. The charging device of claim 54, wherein the tiny gap is set larger than a grain size of a carrier in a developer used in a developing device that is to form the toner image on the surface of the image supporter.

68. The charging device of claim 54, further comprising a cleaning member for cleaning up the surface of the charging member.

69. The charging device of claim 68, wherein the cleaning member is rotationally supported.

70. The charging device of claim 54, wherein the charging member further comprises:

a conductive base body where the charging voltage is applied thereon; and a resistant layer fixed on the conductive base body, wherein protrusions are formed on a portion of the resistant layer other than the portion opposite to the image forming region of the image supporter, to protrude towards the surface of the image supporter, and the spacers are formed by the protrusions.

71. The charging device of claim 54, wherein the charging member further comprises:

a conductive base body where the charging voltage is applied thereon;

a resistant layer fixed on the conductive base body; and a surface layer, deposited on the resistant layer, wherein a thickness of a surface portion where the surface layer is not opposite to the image forming region of the image supporter is thicker than that of a surface portion where the surface layer is opposite to the image forming region of the image supporter, and the spacers are formed by the thicker surface portion of the surface layer.

72. The charging device of claim 54, wherein the charging member further comprises:

a conductive base body where the charging voltage is applied thereon;

a resistant layer fixed on the conductive base body; and a surface layer, deposited on the resistant layer, wherein the surface layer comprises a base material and an electron conductive agent.

73. The charging device of claim 71, wherein a volume resistance rate of the surface layer is set higher than that of the resistant layer.

74. The charging device of claim 72, wherein a volume resistance rate of the surface layer is set higher than that of the resistant layer.

* * * * *